United States Patent [19]

Drabowitch

[11] 3,964,070

[45] June 15, 1976

[54] CORRUGATED HORN HAVING MEANS FOR EXTRACTING DIVERGENCE-MEASURING MODES

[75] Inventor: Serge Drabowitch, Paris, France

[73] Assignee: Thomson-CSF, Paris, France

[22] Filed: Dec. 18, 1974

[21] Appl. No.: 533,772

[30] Foreign Application Priority Data

Dec. 20, 1973 France ..... 73.45822

[52] U.S. Cl. ..... 343/786; 343/852

[51] Int. Cl.[2] ..... H01Q 13/02

[58] Field of Search ..... 343/16 M, 781, 785, 343/786, 852

[56] References Cited

UNITED STATES PATENTS 3,568,204 3/1971 Blaisdell ..... 343/786

*Primary Examiner*—Eli Lieberman

*Attorney, Agent, or Firm*—Karl F. Ross; Herbert Dubno

[57] ABSTRACT

A horn of circular or rectangular cross-section has a multiplicity of circumferential grooves on its diverging inner peripheral wall; these grooves have a depth on the order of a quarter wavelength, at the upper end of the band of operating frequencies, and are separated by distances up to half a wavelength. Other discontinuities in this peripheral surface, serving to pick up odd modes for divergence-measuring purposes, are in the form of probes transverse to the horn wall disposed in one or more grooves or throughgoing slots lying between certain grooves or within same. The discontinuities may be arranged in pairs of diametrically opposite probes or slots, e.g. with two mutually orthogonal pairs disposed in a common transverse plane; probes in adjoining grooves may be interconnected by a transmission line.

10 Claims, 9 Drawing Figures

FIG. 5
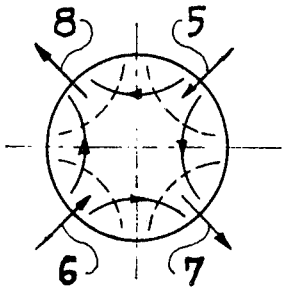
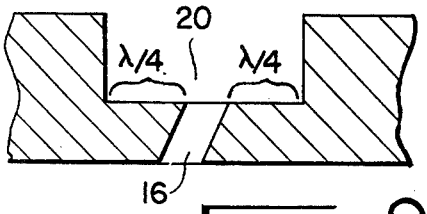
FIG. 9
FIG. 6
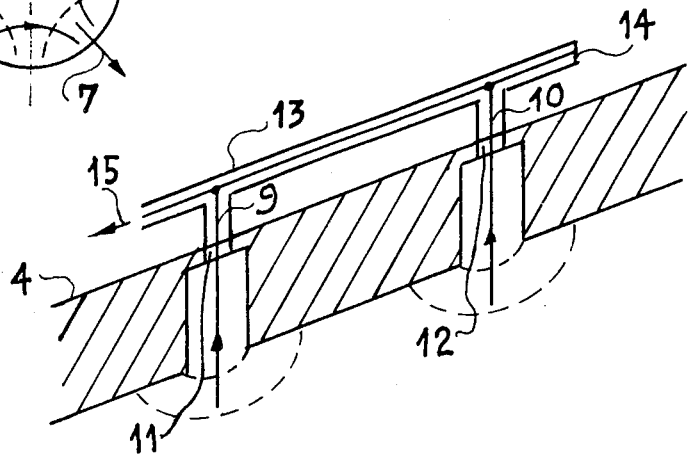
FIG. 7
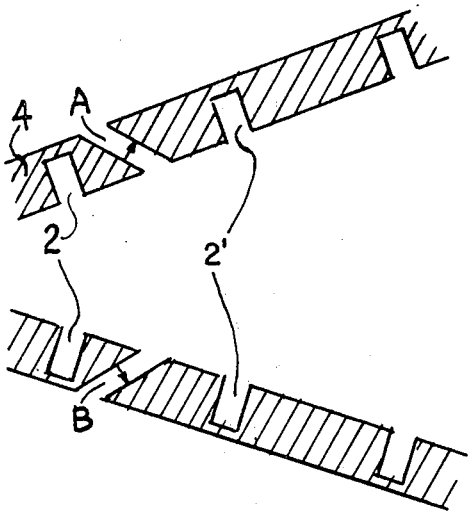
FIG. 8
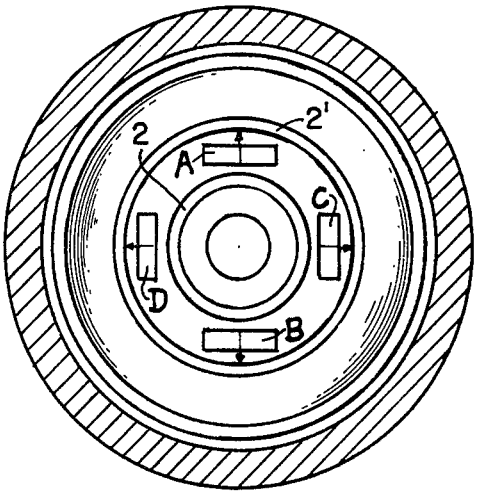

CORRUGATED HORN HAVING MEANS FOR EXTRACTING DIVERGENCE-MEASURING MODES

The present invention relates to a corrugated horn provided with means for extracting divergence-measuring modes. By a corrugated horn is meant a horn whose walls contain transverse grooves of a depth on the order of one-quarter of the operating wavelength which are spaced apart by a fraction of that wavelength.

In tracking antennas used in space-communication links and/or in radar the divergence-measuring signal is obtained in the following manner: a focusing system, formed by one or more reflectors or lenses which are generally defined by surfaces of revolution, contains a primary source which is generally a horn. When the radioelectrical axis of the antenna does not coincide exactly with the line along which the radiating object in question lies, the focusing system excites the primary horn in an asymmetrical fashion and, in addition to the useful main mode, gives rise therein to modes of propagation having opposed symmetry characteristics whose amplitudes and phases in relation to the main mode are characteristic of the direction sought and may be used to produce divergence-measuring signals. However, to prevent losses due to mismatching, principally in the field of telecommunication through space, it is desirable for the telecommunication channel, i.e. the sum channel, not to pass through a labyrinth of couplers, as it often does in monopulse feeds, but to be directly accessible, the divergence-measuring or difference channels being established by coupling arrangements. To do this, various means are used to extract the signals produced by the modes which are due to divergence. In principle these signal extractors may be of any type whatsoever, i.e. monopole, slot or loop, and to fulfill their function in the best way possible they need to have the following characteristics:

a. the extractors should have only slight coupling with the useful fundamental mode, less than 20 or 30 dB for example.

b. they should be well-matched over the band to be covered, which may for example mean that they have a voltage standing-wave ratio of less than 2 or 3.

There are other conditions which need to be taken into account and these relate to the gain factor and consequently to the radiation temperature in the reception channel for the useful fundamental mode.

The amplitude and phase of the radiation diagrams need to be as close together as possible in both the electrical and the magnetic plane, it being assumed that the horn is excited with linear polarization. This being so, if the horn is of circular cross-section, the radiation diagrams has a surface characteristic of revolution and this may be particularly suitable for a focusing system which is a surface of revolution. In addition, it can be demonstrated that in this case the level of crossed polarization is theoretically zero at any point in space.

The amplitude and phase characteristics of the diagrams ought to be as constant as possible throughout the frequency band to be covered and in addition radiation in directions outside the outline of the system, as for instance the spillover, should be as low as possible. This latter characteristic implies a minimum level of side lobes.

These latter conditions emphasize the usefulness of using corrugated horns whose polar diagrams are virtually volumes of revolution and which have very small side lobes and stable amplitude and phase characteristics over frequency ranges of only slightly less than an octave.

However, when the tracking channels are excited in a corrugated horn by coupling onto the main channel, great difficulties are encountered as a result of the theoretically infinite surface reactance of the walls. In many instances, the required surface reactance is simulated by means of narrow and closely spaced transverse grooves or striations of a depth corresponding to approximately a quarter of the wavelength. However, experience has shown that it is possible to space the grooves a considerable distance apart and that this distance may amount to approximately half the minimum wavelength transmitted.

In accordance with the invention, I utilize this possibility and the particular orientation of the lines of field and current in the vicinity of the horn periphery to provide the wall with divergence-measuring discontinuities which meet the requirements defined above.

In accordance with the invention, a corrugated horn having means for extracting divergence-measuring modes is positioned in an electromagnetic-wave-propagation system within an antenna structure able to cooperate with an object to be tracked, and adapted to propagate a hybrid fundamental mode and to convey odd modes derived therefrom. The horn has a plurality of grooves formed in its walls, with a depth on the order of one quarter of a wavelength at the upper end of the band of operating frequency here considered, the grooves being spaced apart a substantial fraction of that wavelength up to substantially half of a wavelength. The aforementioned discontinuities, serving as inputs for a divergence-measuring circuit, have an extent in the direction of the horn axis which is substantially less than the spacing of the circumferential grooves; they may be probes extending generally radially in the grooves, or throughgoing slots disposed in the wall of the horn, so as to pick up the odd modes propagating therein for deriving angular data therefrom.

The above and other features of my invention will become apparent from the following description of certain embodiments given with reference to the accompanying drawing in which:

FIG. 5 is a diagrammatic representation of the $TE_{21}$ mode excited in the horn of FIG. 4;

FIG. 6 is an axial sectional view of a modified horn according to my invention;

FIGS. 7 and 8 are diagrammatic views in axial and transverse section of a corrugated horn according to my invention in which the coupling formation are slots; and FIG. 9 is a fragmentary sectional view showing another modification.

Figure 1:
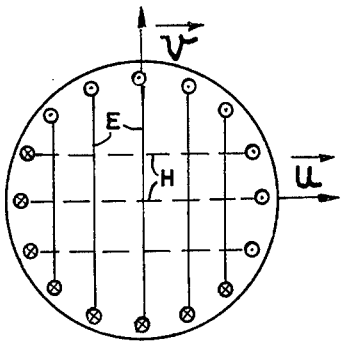
FIG. 1 is a diagram showing field lines and current in a conventional frustoconical horn having narrow, closely spaced inner peripheral groves.

In FIG. 1 I have schematically illustrated the layout of the field and current lines corresponding to the hybrid mode in a circular corrugated horn having narrow, closely spaced grooves. The electrical field $\vec{E}$ is represented by solid lines whereas the magnetic field $\vec{H}$ is represented by broken lines. The circled dots represent sources, the circled crosses represent sinks and $\vec{u}, \vec{v}$ represent the unit vectors for the horizontal and vertical directions.

It will be noted in this figure that:

1. the transverse components of the fields $\vec{E}$ and $\vec{H}$ are everywhere orthogonal and are distributed according to the same law of revolution in any cross-sectional plane;
2. at the wall, the magnetic field and the electrical field are longitudinal or zero;
3. consequently the electrical current is transverse or zero.

Figure 2:
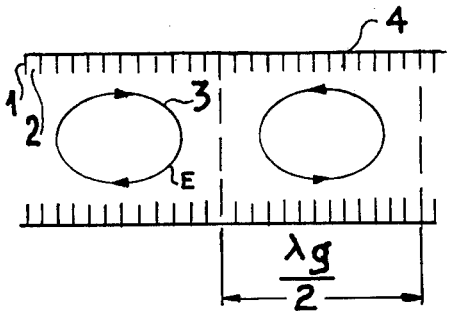
FIG. 2 PRIOR ART
FIG. 2 is a diagram showing the distribution of the electrical field in such a corrugated horn.

The pattern of distribution of the electrical field lines in an axial plane parallel to field $\vec{E}$ may be given as an example. In FIG. 2 it can be seen that these are closed loops 3 which are alternately oriented in opposite directions with an interval of $\lambda g/2$ and which are propagated with the phase velocity of the mode ($\lambda g$ = guide wavelength). Identical lines would be obtained in the case of the magnetic field. This figure also shows the wall 4 of the horn formed with a multiplicity of closely spaced transverse peripheral grooves 2 separated by narrow partitions 1. However, with this configuration it is not advisable to insert probes in the horn since they would constitute an unacceptable mismatch.

Figure 3:
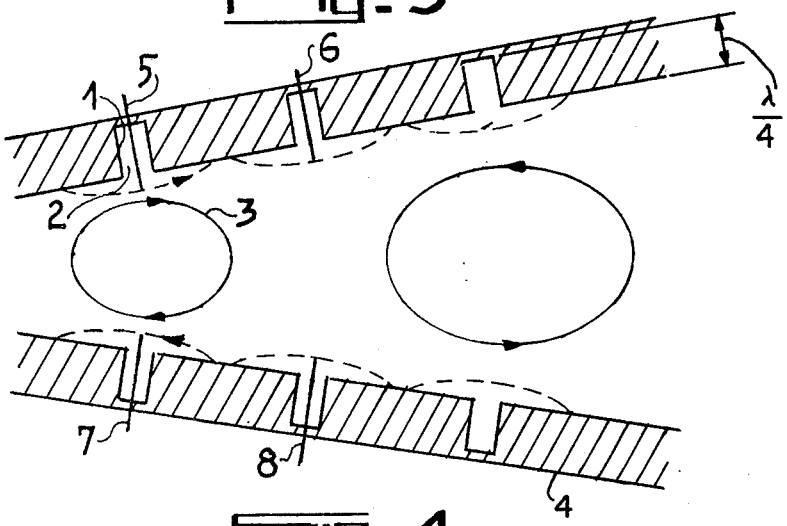
FIG. 3 is a schematic axial sectional view of a corrugated horn according to my invention having spaced grooves with generally coaxial probes.

I therefore prefer to use, in accordance with the invention, a diverging horn of circular or rectangular cross-section having spaced circumferential grooves, as shown in a very schematic manner in FIG. 3 in which the separation of these grooves substantially exceeds their width.

At the wall 4 of the horn the electrical field is everywhere either orthogonal to the surface or zero and the grooves 2 are excited by a resonant mode. The grooves may be considered as performing the function of traps which block longitudinal currents. At a certain distance from the wall the electrical field lines again form loops 3, characteristic of the $HE_{11}$ hybrid mode.

In this way I am enabled to introduce probes into the grooves 2, through openings made for this purpose in wall 4 of the horn, without disturbing the fundamental $HE_{11}$ hybrid mode.

In FIG. 3 a number of such probes 5–8 extend substantially radially, perpendicularly to the diverging wall surface, into certain grooves 2 and project into the horn by a distance equal to a fraction of the wavelength. In this position it is capable of radiating a field with practically no coupling to the $HE_{11}$ mode.

Figure 4:
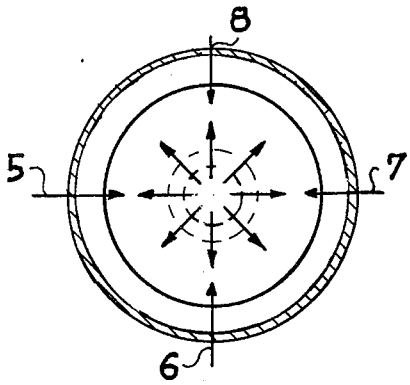
FIG. 4 is a cross-sectional view of a horn similar to that shown in FIG. 3, including a diagrammatic representation of the $TM_{01}$ radial mode excited in a horn.

Thus, the symmetrical character of the coaxial mode prevents any coupling to the resonant mode which corresponds to the normal operation of the groove performing the function of a trap. In the interior of the horn, it can be seen that the electrical field is once again almost perfectly longitudinal; the field there is thus orthogonal to the probe and is inherently decoupled therefrom. In other respects, each radial probe 5–8 is able to radiate with acceptable matching since it behaves approximately as a unipolar member radiating above a member (formed by wall 4) having a reflective surface whose width may be as much as one wavelength, the space between the grooves being possibly as much as half a wavelength wide. The use of relatively widely spaced grooves is precisely that which allows a probe to be inserted which is sufficiently well-matched to the feed line. If a group of two or four such probes, for example, is arranged radially and symmetrically on the circumference of a groove, as illustrated in FIG. 4, and if the diameter of this groove is made such that the desired mode is capable of propagation to the exclusion of interference modes, and if these probes are excited in phase, the "radial" mode $TM_{01}$ may be excited. The diagram obtained, which is shown in FIG. 4, is symmetrically and radially polarized. Near the axis the pattern of the electrical field is of the form:

$$\vec{d}(\alpha,\phi) \approx A \sin\phi\,(\vec{u}\cos\alpha + \vec{v}\sin\alpha) \qquad 1.$$

where $\alpha$ and $\phi$ are spherical co-ordinates along any direction in relation to the axis of the system. In expression (1), A is a constant and $\vec{u}, \vec{v}$ are the unit vectors in the horizontal and vertical directions.

In any diametric plane whatsoever the diagram obtained has an odd zero characteristic, on the axis, of slope A. If the received wave is circularly polarized, this diagram which is demodulated by a fixed reference (the fundamental mode $HE_{11}$) provides the desired angular divergences with the aid of conventional techniques not further described here.

Other types of diagram may be used for divergence-measuring. As an example, the four radial probes 5 to 8 may be combined alternately in phase and in phase opposition. In the vicinity of the axis the $TE_{21}$ mode obtained, which is shown in FIG. 5, is expressed by the equation:

$$\vec{d}'(\alpha,\phi) = A \sin\phi\,(\vec{u}\cos\alpha - \vec{v}\sin\alpha) \qquad 2.$$

It can be shown that the simultaneous employment of two diagrams $d$ and $d'$ allows the desired angular divergences ($\alpha$ and $\phi$) to be defined whatever the polarization of the incident wave. These divergences may be determined by calculation.

If the four (or two) substantially coplanar probes of FIG. 4 are replaced by loops there is a changeover between the electrical and magnetic fields and the mode obtained is the tangential mode $TE_{01}$ which has the advantage that in a corrugated horn it has the same phase velocity and the same cut-off frequency as the $TM_{01}$ mode.

In the arrangement just described, several divergence-measuring probes are used which project into the corrugated horn from a single groove.

Alternatively, and as already indicated in FIG. 3, it is possible to use a plurality of grooves to accomodate the probes. FIG. 6 is a schematic view of such an embodiment in a sectional axial plane. A plurality of probes 9 and 10 are disposed in the same axial plane in openings 11, 12 giving access to a plurality of successive grooves. These probes are excited with a variable amplitude and a progressive phase using a technique known for directional couplers. The probes, which extract the divergence-measuring signals in this way, are connected to a common transmission line 13 having one end 14 short-circuited and the other end 15 connected to a coupler (T, hybrid, etc. . . ) which enables to useful signal to be extracted. To extract the useful modes, this same structure may be duplicated in a number of axial planes (four, for example) which are symmetrically positioned. In this case, the conductors 13 in the various axial planes are connected together to form a directional radiating array. Transmission line 13 forms part of a divergence-measuring circuit, not further illustrated, whose inputs are the probes 9, 10.

The advantages of such an arrangement are as follows:

- the matching of the divergence-measuring channels is the better the larger the number of probes (each of them being that much less coupled),
- the excitation of the useful mode is assisted since the array, being directional, excites no mode in the direction of the throat of the horn or, as viewed from the reception end, is not sensitive to the diverence-measuring mode which is reflected toward the bottom of the horn and passes back toward its opening.

The residue of the fundamental mode $HE_{11}$ which is coupled into the array is found at the unused outlet 14 of the coupler, which may be short-circuited. This coupling therefore does not give rise to an increase in noise temperature. The corresponding resonant pattern is only slightly selective if the coupler is of limited length.

It has also been seen that, as a first approximation, the grooves can be considered to perform the function of traps which block longitudinal currents. The horn is therefore smooth-walled between two successive grooves. It is excited by modes whose phase velocities are different but, since the distance between two grooves is small (generally less than half the wavelength), the longitudinal current which results from variations in phase cannot take on a high value and remains pratically zero.

This being so, it can be seen that it is possible to form transverse openings in the wall between two grooves virtually without cutting any current lines and thus without disturbing the propagation and radiation of the fundamental $HE_{11}$ mode. As a consequence this mode generates very little energy in such slots by coupling. What is more, this is confirmed by experience. It is therefore possible to substitute slots for the probes in order to extract the useful divergence-measuring modes. FIGS. 7 and 8 schematically show such a corrugated horn formed with throughgoing slots A, B, C, D near the narrow end of its frustoconical wall 4.

A number (four, for example) of these symmetrically positioned slots A–D between two consecutive grooves 2, 2' are able to extract modes which can be used for divergence-measuring, such as the $TM_{01}$ and $TE_{21}$ modes given by equations (1) and (2), or any mutually orthogonal combination thereof.

Since, ideally, the longitudinal current is zero, slots A, B, C, D do not cut across any current lines. To extract the $TE_{01}$ mode it is necessary to make longitudinal slots, which results in a certain amount of coupling with transverse components.

There has thus been described a primary feed system which includes a corrugated horn having relatively widely spaced inner peripheral grooves, the diverging horn wall being provided within or between these grooves with discontinuities designed for divergence-measuring. These discontinuities may be either pairs of generally coaxial probes positioned radially within certain grooves, or slots which lie skew to the axis of propagation and which are positioned between two consecutive grooves. These probes or slots, extending axially over substantially less than the groove spacing, may be symmetrically positioned in one or more cross-sectional planes through the horn and may be interconnected by circuitry such as transmission line 13 to produce the desired diagrams.

Furthermore, as long as there remains on either side of the coupling formation a smooth land of an axial width greater than $\lambda/4$ the spacing between the grooves is less than $\lambda/2$, there is no disadvantage in allowing an excitation slot to open into the interior of the groove. This has been illustrated in FIG. 9 where a slot 16 terminates in a groove 20.

The structures here described have the desired characteristics mentioned, i.e. a low level of coupling to the fundamental mode of the corrugated horn and consequently negligible disturbance of this mode, and the possibility of combining the signals originating from the probes by means of simple couplers By virtue of the advantages and characteristics of the corrugated horns according to my invention they are ideally suited to form monopulse feeds, in particular for tracking radars.

What is claimed is:

1. A horn for an antenna system, comprising a wall centered on an axis with an inner peripheral surface diverging from said axis from one end to the other, said wall being provided on said surface with a multiplicity of circumferential grooves having a depth on the order of a quarter wavelength of an operating frequency, the axial spacing of said grooves being a substantial fraction of said wavelength up to substantially half said wavelength, and divergence-measuring circuitry responsive to odd modes derived from a hybrid fundamental mode propagated along said axis, said circuitry having input formations in the shape of discontinuities of said surface, the extent of said discontinuities in the direction of said axis being substantially less than the axial spacing of said grooves.

2. A horn as defined in claim 1 wherein said input formations are disposed at diametrically opposite locations.

3. A horn as defined in claim 1 wherein said input formations are disposed in certain of said grooves, said circuitry including a transmission line with a short-circuited termination.

4. A horn as defined in claim 3 wherein said input formations are probes extending generally radially to said axis through said wall.

5. A horn as defined in claim 3 wherein said probes are located in adjacent grooves.

6. A horn as defined in claim 1 wherein said input formations are peripherally extending throughgoing slots.

7. A horn as defined in claim 6 wherein said slots are disposed between adjoining grooves.

8. A horn as defined in claim 6 wherein said slots open into said grooves.

9. A horn as defined in claim 6 wherein said slots are flanked by smooth lands extending axially over at least a quarter wavelength.

10. A horn as defined in claim 1 wherein said input formations are disposed in the vicinity of said one end.

* * * * *